US012342942B2

(12) United States Patent
Lin

(10) Patent No.: US 12,342,942 B2
(45) Date of Patent: Jul. 1, 2025

(54) INFLATABLE CUSHION STRUCTURE

(71) Applicant: FENG YI OUTDOOR LEISURE EQUIPMENT ENTERPRISE CO., LTD., Taichung (TW)

(72) Inventor: Ping-Ting Lin, Taichung (TW)

(73) Assignee: FENG YI OUTDOOR LEISURE EQUIPMENT ENTERPRISE CO., LTD., Taichung (TW)

( * ) Notice: Subject to any disclaimer, the term of this patent is extended or adjusted under 35 U.S.C. 154(b) by 181 days.

(21) Appl. No.: 18/458,334

(22) Filed: Aug. 30, 2023

(65) Prior Publication Data

US 2025/0072629 A1 Mar. 6, 2025

(51) Int. Cl.
*A47C 27/08* (2006.01)
*A47C 27/00* (2006.01)

(52) U.S. Cl.
CPC ..... *A47C 27/087* (2013.01); *A47C 27/081* (2013.01); *A47C 27/08* (2013.01)

(58) Field of Classification Search
CPC ..... A47C 27/087; A47C 27/08; A47C 27/081; A47C 27/082; A47C 27/083; A47C 27/10; A61G 7/05769; A61G 7/05776
USPC ..... 5/655.3, 654, 644, 706, 710–713
See application file for complete search history.

(56) References Cited

U.S. PATENT DOCUMENTS 277,979 A * 5/1883 Blochman et al. .. A47C 27/081 5/644
622,239 A * 4/1899 Lane ..... A47C 27/081 5/712
679,680 A * 7/1901 Langer ..... A47C 27/081 5/696
684,554 A * 10/1901 Sawtell ..... A47C 27/081 5/712
802,526 A * 10/1905 Russell, Jr. ..... A47C 27/087 5/711
2,016,054 A * 10/1935 Sentell ..... A47C 27/081 52/2.18
4,328,599 A * 5/1982 Mollura ..... A47C 27/088 5/682
4,541,135 A * 9/1985 Karpov ..... A47C 27/087 5/710
4,826,715 A * 5/1989 Lee ..... A47C 27/081 428/64.1
6,973,690 B2 * 12/2005 Muci ..... A47C 27/081 5/644

(Continued)

*Primary Examiner* — Robert G Santos
(74) *Attorney, Agent, or Firm* — Chun-Ming Shih; LANWAY IPR SERVICES

(57) ABSTRACT

An inflatable cushion structure includes an inflatable cushion, a connecting unit, and a separating material unit. The inflatable cushion includes a upper surface layer, a lower surface layer, and multiple air passages. The connecting unit is mounted in each of the air passages and includes a first connecting member provided with multiple first transverse slits and a second connecting member provided with multiple second transverse slits. The separating material unit includes multiple separation plates each having a left end passing through one of the first transverse slits and a right end passing through one of the second transverse slits. Thus, the separation plates divide each of the air passages into multiple partition layers, so that the partition layers form a spacing between the upper surface layer and the lower surface layer.

8 Claims, 8 Drawing Sheets

(56) References Cited

U.S. PATENT DOCUMENTS

| | | | | |
|---|---|---|---|---|
| 7,191,481 | B2 * | 3/2007 | Hsu | A47C 27/087 5/712 |
| 7,694,372 | B1 * | 4/2010 | Boyd | A47C 27/081 5/711 |
| 8,266,744 | B2 * | 9/2012 | Song | A47C 27/081 5/711 |
| 10,631,659 | B2 * | 4/2020 | Xia | B29C 66/1122 |
| 12,082,702 | B1 * | 9/2024 | Tang | A47C 27/087 |
| 2004/0010853 | A1 * | 1/2004 | Muci | A47G 9/1027 5/644 |
| 2006/0130240 | A1 * | 6/2006 | Hsu | A47C 27/081 5/712 |
| 2009/0320211 | A1 * | 12/2009 | Lau | A47C 27/087 5/713 |
| 2012/0031265 | A1 * | 2/2012 | Song | A47C 27/087 92/145 |
| 2017/0238718 | A1 * | 8/2017 | Xia | B29C 65/04 |
| 2025/0072629 | A1 * | 3/2025 | Lin | A47C 27/087 |

* cited by examiner

INFLATABLE CUSHION STRUCTURE

BACKGROUND OF THE INVENTION

Field of the Invention

The present invention relates to a cushion and, more particularly, to an inflatable cushion structure.

Description of the Related Art

A conventional inflatable cushion 10 in accordance with the prior art shown in FIG. 1 comprises a upper surface layer 11, a lower surface layer 12, multiple air passages 13, and an air valve 14. The air passages 13 are formed between the upper surface layer 11 and the lower surface layer 12. The air valve 14 is provided on a side of the upper surface layer 11. The air flows through the air passages 13 and is filled with the conventional inflatable cushion 10. In practice, the air passage 13 are packed with warming materials, such as fluff, cotton wool or other lightweight items, to achieve a warming effect. However, the air is circulated through the air passages 13 so that the lightweight warming materials cannot be fixed at the same position. Thus, the warming materials are not evenly distributed in the air passages 13, thereby reducing the warming or thermal insulation effect and affecting the speed of inflation.

BRIEF SUMMARY OF THE INVENTION

The primary objective of the present invention is to provide an inflatable cushion structure with multiple spacing layers to achieve a warming effect.

In accordance with the present invention, there is provided an inflatable cushion structure comprising an inflatable cushion, a connecting unit, and a separating material unit. The inflatable cushion includes a upper surface layer, a lower surface layer, multiple air passages, and an air valve. The upper surface layer has an interior coated with a TPU (thermoplastic polyurethane) layer. The lower surface layer has an interior coated with a TPU layer. The TPU layers of the upper surface layer and the lower surface layer are air impermeable and are adhered mutually. A periphery of the upper surface layer and the lower surface layer is sealed and fused. The upper surface layer and the lower surface layer are stuck by a melting machine to form the air passages. The air passages are parallel and connected to each other. The air valve is provided on a side of the inflatable cushion. The connecting unit is mounted in each of the air passages of the inflatable cushion. The connecting unit includes a first connecting member and a second connecting member. The first connecting member and the second connecting member are made of TPU or soft plastic material. The first connecting member is located at a left side of each of the air passages. The first connecting member is provided with multiple first transverse slits. The second connecting member is located at a right side of each of the air passages. The second connecting member is provided with multiple second transverse slits. The separating material unit includes multiple separation plates. Each of the separation plates has a left end passing through one of the first transverse slits of the first connecting member. Each of the separation plates has a right end passing through one of the second transverse slits of the second connecting member.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
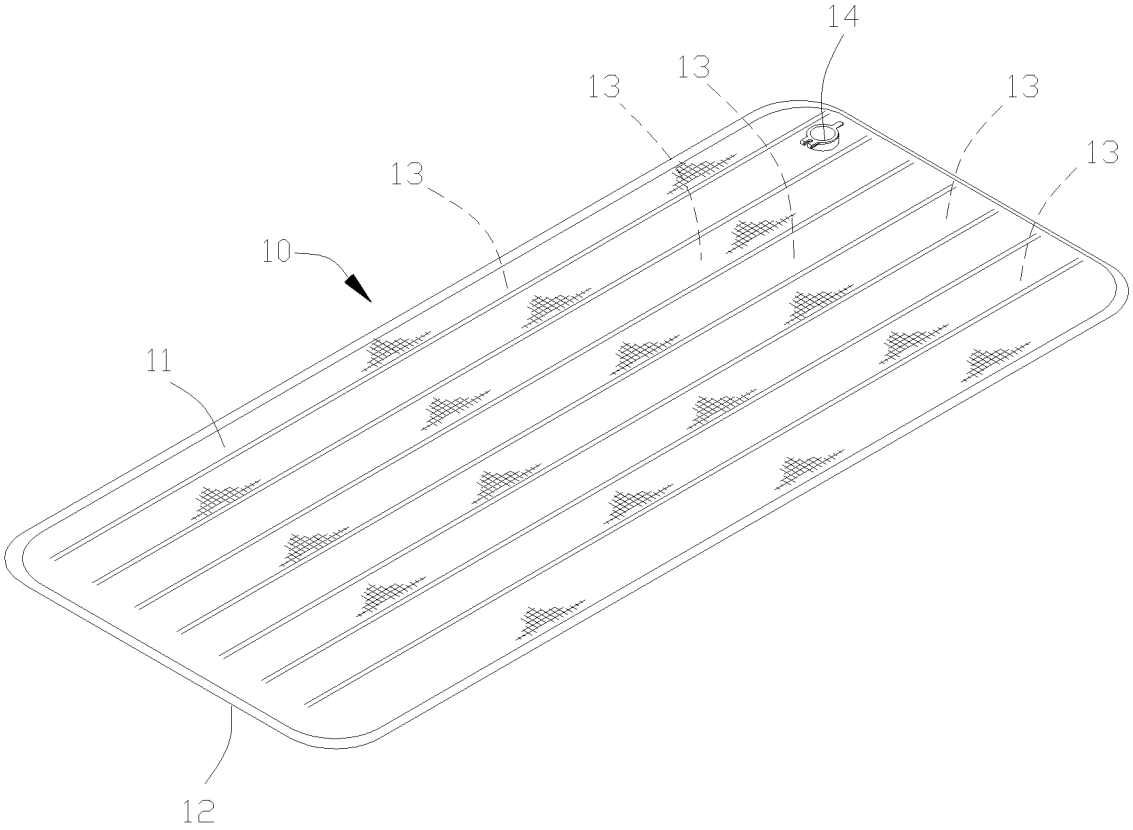
FIG. 1 PRIOR ART
FIG. 1 is a perspective view of a conventional inflatable cushion in accordance with the prior art.
Figure 2:
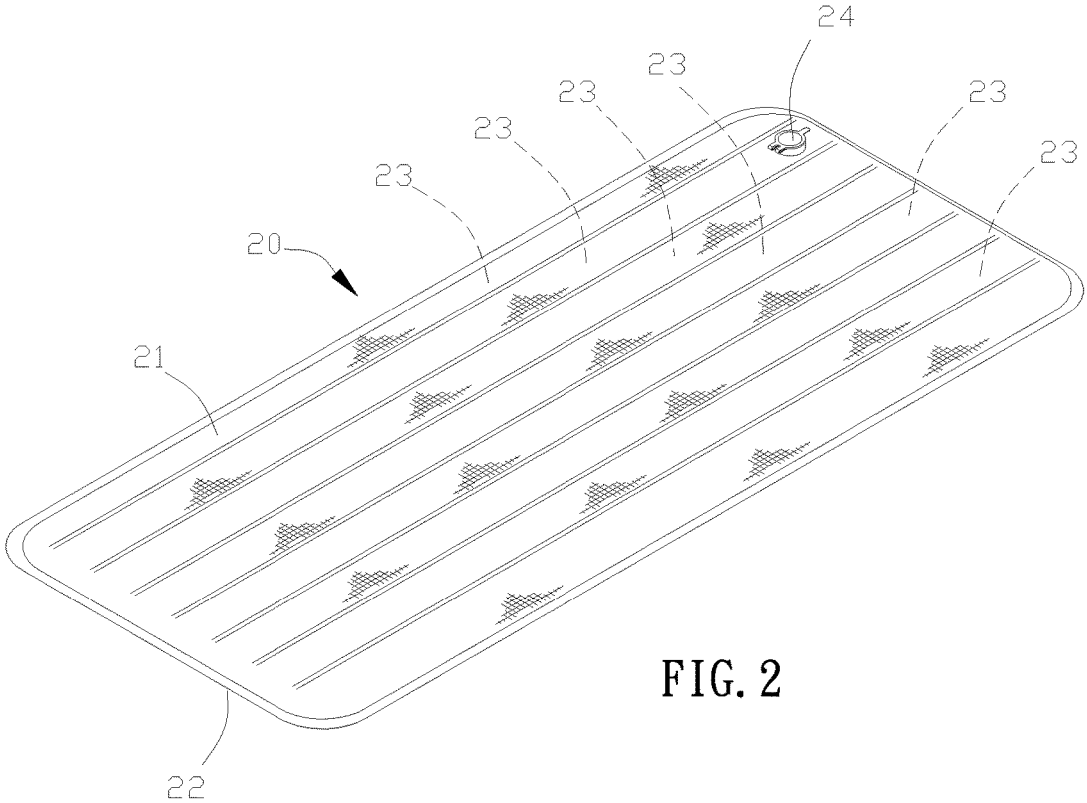
FIG. 2 is a perspective view of an inflatable cushion structure in accordance with the preferred embodiment of the present invention.
Figure 3:
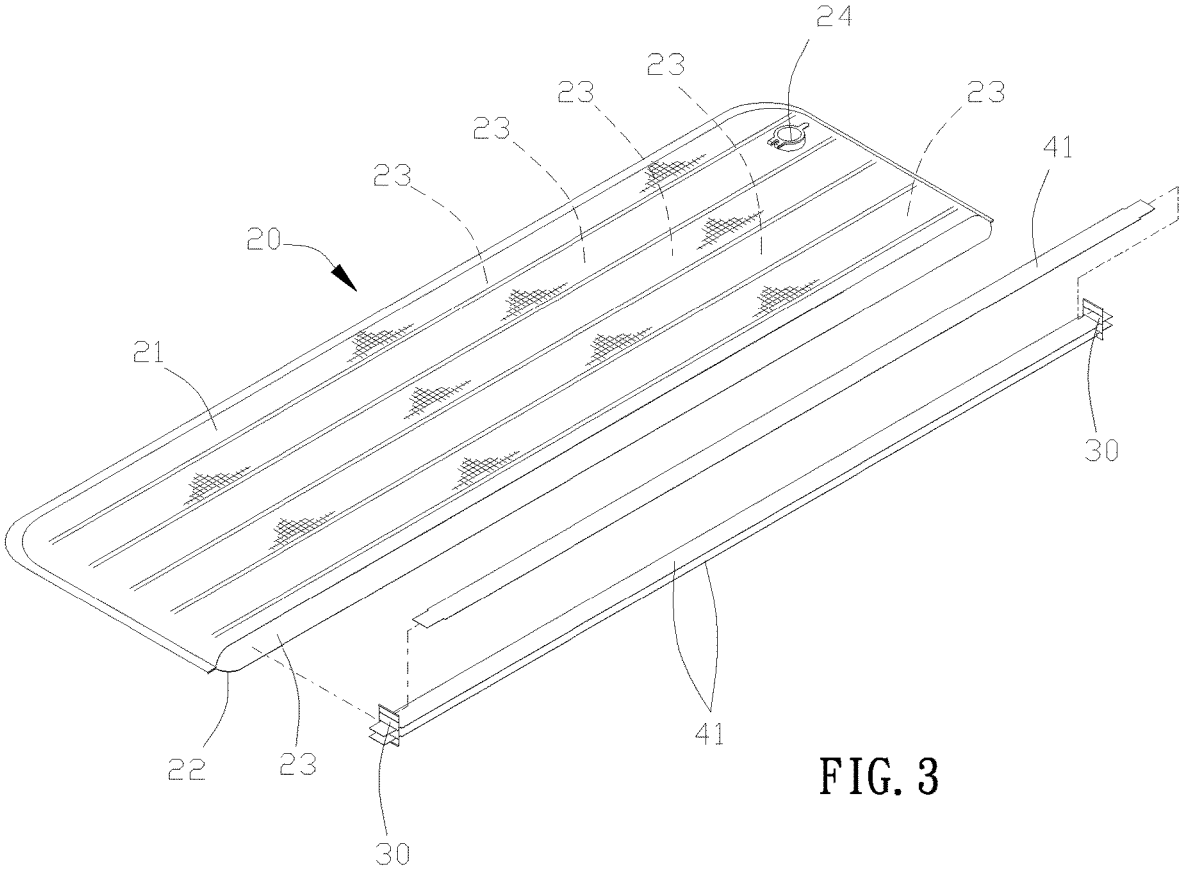
FIG. 3 is a partial exploded perspective view of the inflatable cushion structure in accordance with the preferred embodiment of the present invention.
Figure 4:
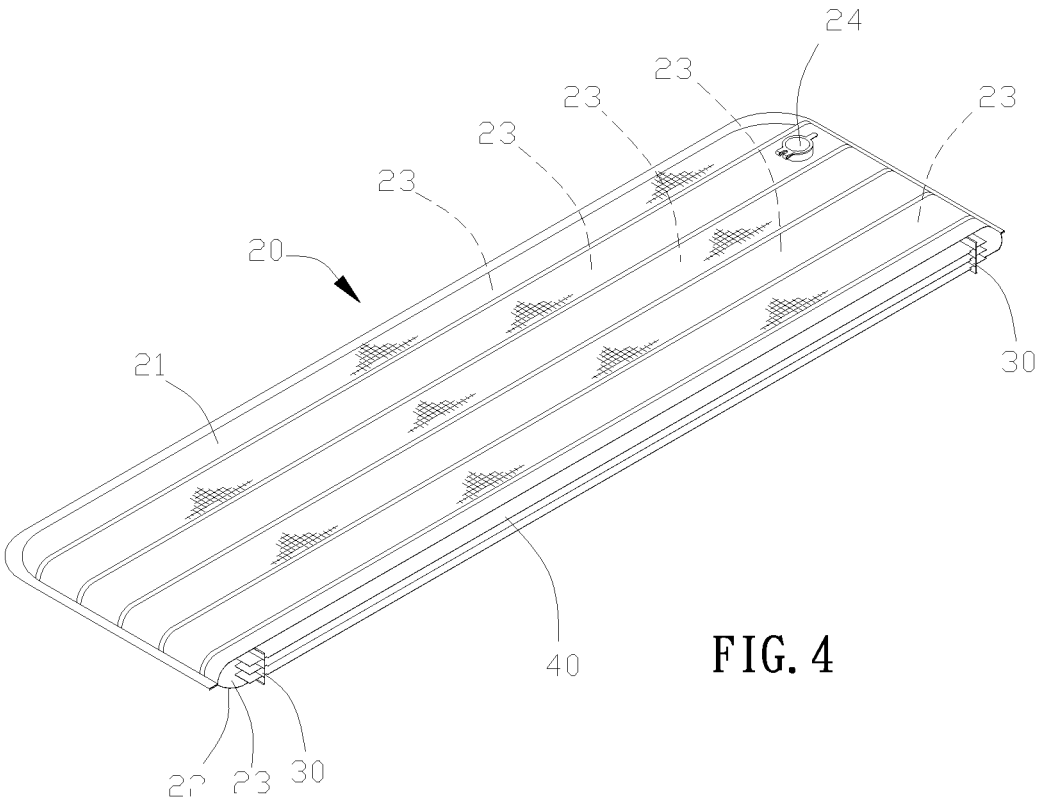
FIG. 4 is a partial perspective view of the inflatable cushion structure in accordance with the preferred embodiment of the present invention.
Figure 5:
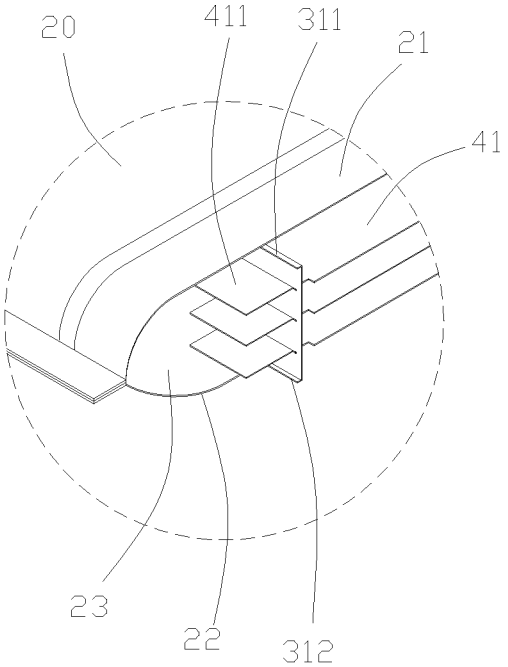
FIG. 5 is a locally enlarged view of the inflatable cushion structure as shown in FIG. 4.
Figure 6:
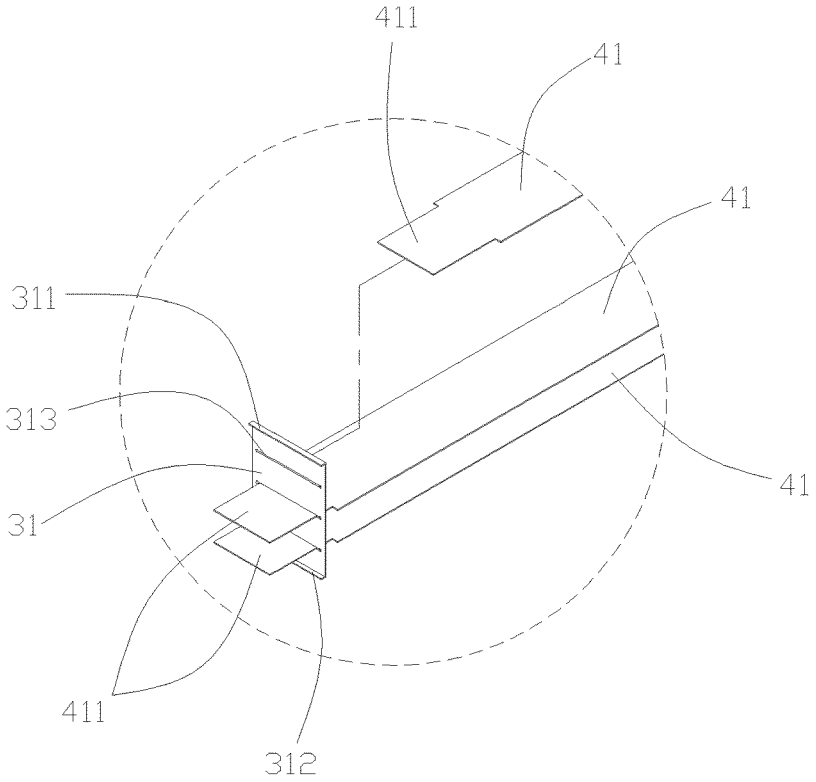
FIG. 6 is a partial exploded perspective view of the inflatable cushion structure in accordance with the preferred embodiment of the present invention.
Figure 7:
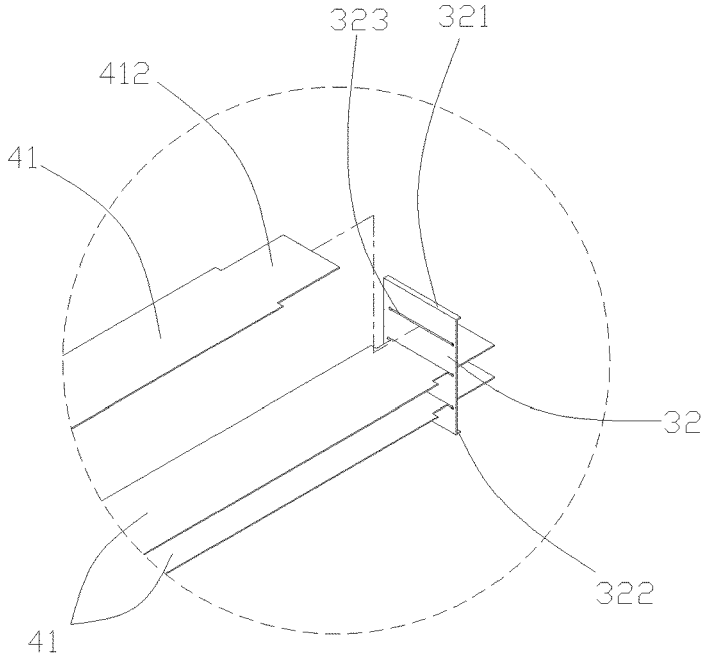
FIG. 7 is a partial exploded perspective view of the inflatable cushion structure in accordance with the preferred embodiment of the present invention.

Referring to the drawings and initially to FIGS. 2-8, an inflatable cushion structure in accordance with the preferred embodiment of the present invention comprises an inflatable cushion 20, a connecting unit 30, and a separating (or dividing or spacing or isolating) material unit 40.

The inflatable cushion 20 includes a upper surface layer 21, a lower surface layer 22, multiple air passages 23, and an air valve 24. The upper surface layer 21 has an interior coated with a TPU (thermoplastic polyurethane) layer. The lower surface layer 22 has an interior coated with a TPU layer. The TPU layers of the upper surface layer 21 and the lower surface layer 22 are air impermeable and are adhered mutually. A periphery of the upper surface layer 21 and the lower surface layer 22 is sealed and fused (or melted). The upper surface layer 21 and the lower surface layer 22 are stuck (or heat sealed) by a melting (or fusing) machine to form the air passages 23. The air passages 23 are parallel and connected to each other. The air valve 24 is provided on a side of the inflatable cushion 20.

The connecting unit 30 is mounted in each of the air passages 23 of the inflatable cushion 20. The connecting unit 30 includes a first connecting member 31 and a second connecting member 32. The first connecting member 31 and the second connecting member 32 are made of TPU or soft plastic material. The first connecting member 31 is located at a left side of each of the air passages 23. The first connecting member 31 is provided with multiple first transverse slits 313. The second connecting member 32 is located at a right side of each of the air passages 23. The second connecting member 32 is provided with multiple second transverse slits 323.

The separating material unit 40 is mounted in each of the air passages 23 of the inflatable cushion 20. The separating material unit 40 includes multiple separation plates (or spacers) 41. Each of the separation plates 41 has a left end 411 passing through one of the first transverse slits 313 of the first connecting member 31. Each of the separation plates 41 has a right end 412 passing through one of the second transverse slits 323 of the second connecting member 32.

In the preferred embodiment of the present invention, the first connecting member 31 has an upper part provided with a first upper adhesive (or sticky) portion 311 secured to the upper surface layer 21 of the inflatable cushion 20. The first upper adhesive portion 311 is fused (or melted) and positioned with the TPU layer in the upper surface layer 21. The first connecting member 31 has a lower part provided with a first lower adhesive (or sticky) portion 312 secured to the lower surface layer 22 of the inflatable cushion 20. The first lower adhesive portion 312 is fused (or melted) and positioned with the TPU layer in the lower surface layer 22. The second connecting member 32 has an upper part provided with a second upper adhesive (or sticky) portion 321 secured to the upper surface layer 21 of the inflatable cushion 20. The second upper adhesive portion 321 is fused (or melted) and positioned with the TPU layer in the upper surface layer 21. The second connecting member 32 has a lower part provided with a second lower adhesive (or sticky) portion 322 secured to the lower surface layer 22 of the inflatable cushion 20. The second lower adhesive portion 322 is fused (or melted) and positioned with the TPU layer in the lower surface layer 22.

In the preferred embodiment of the present invention, the first transverse slits 313 of the first connecting member 31 are equally spaced from each other from top to bottom.

In the preferred embodiment of the present invention, the second transverse slits 323 of the second connecting member 32 are equally spaced from each other from top to bottom.

In the preferred embodiment of the present invention, the separation plates 41 have a number equal to that of the first transverse slits 313 and that of the second transverse slits 323.

In the preferred embodiment of the present invention, each of the separation plates 41 is made of soft material including an aluminum film or a polyester film.

Figure 8:
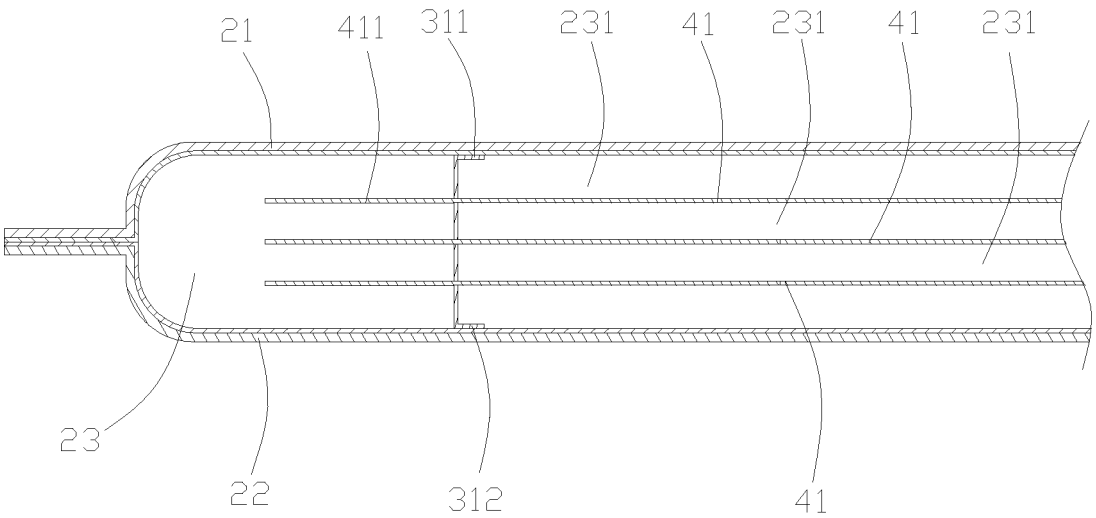
FIG. 8 is a partial cross-sectional view of the inflatable cushion structure in accordance with the preferred embodiment of the present invention.

In assembly, the left end 411 of each of the separation plates 41 extends through one of the first transverse slits 313 of the first connecting member 31, and the right end 412 of each of the separation plates 41 extends through one of the second transverse slits 323 of the second connecting member 32. Then, the first connecting member 31 is positioned at the left side of each of the air passages 23, and the second connecting member 32 is positioned at the right side of each of the air passages 23. Thus, each of the air passages 23 is divided into multiple partition layers 231 by the separation plates 41 as shown in FIG. 8. The partition layers 231 are equally spaced from each other from top to bottom.

When the inflatable cushion 20 is not in use, the inflatable cushion 20 is deflated, folded, and stored. At this time, the connecting unit 30 is made of TPU or soft plastic material, and each of the separation plates 41 is made of soft material including an aluminum film or a polyester film. Thus, the connecting unit 30 and the separation plates 41 are flexible and bendable so that the connecting unit 30 and the separation plates 41 will not interfere with folding of the inflatable cushion 20.

When the inflatable cushion 20 is in use, the air valve 24 is opened to allow air entering the inflatable cushion 20. When the air is filled with the inflatable cushion 20, the upper surface layer 21 and the lower surface layer 22 of the inflatable cushion 20 are expanded, so that the first upper adhesive portion 311 and the second upper adhesive portion 321 are moved upward with the upper surface layer 21, while the first lower adhesive portion 312 and the second lower adhesive portion 322 are moved downward with the lower surface layer 22. Thus, each of the air passages 23 is formed with the partition layers 231 by the separation plates 41 so that the air is filled with the partition layers 231.

Thus, each of the air passages 23 is divided into the partition layers 231 to slow down the air flow in each of the air passages 23, thereby achieving a warming effect. In addition, each of the separation plates 41 is made of soft material including an aluminum film or a polyester film so that the separating material unit 40 is bendable, has a high reflectivity and low absorption rate, to reduce temperature radiation efficiently, thereby achieving a warming effect.

Figure 9:
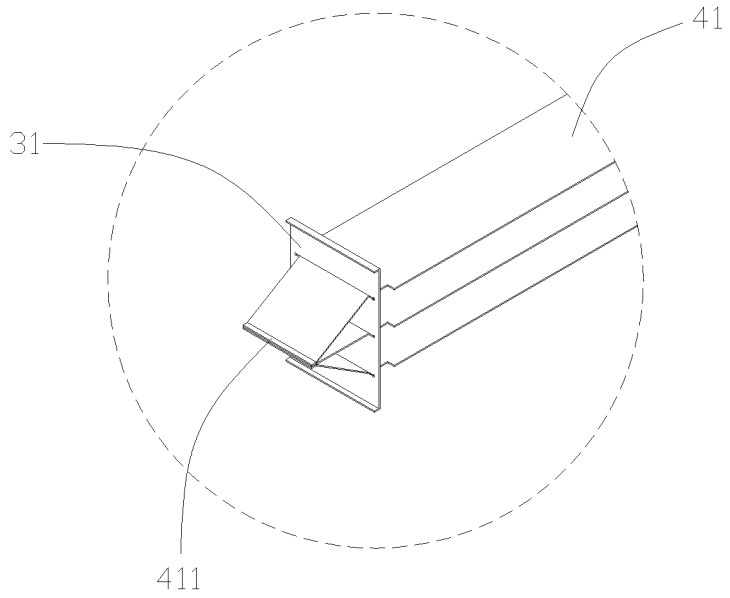
FIG. 9 is a locally perspective enlarged view of an inflatable cushion structure in accordance with another preferred embodiment of the present invention.

Referring to FIG. 9, the left ends 411 of the separation plates 41 are fixed together, and the right ends 412 of the separation plates 41 are fixed together, to limit movement of the separation plates 41 in each of the air passages 23.

Figure 10:
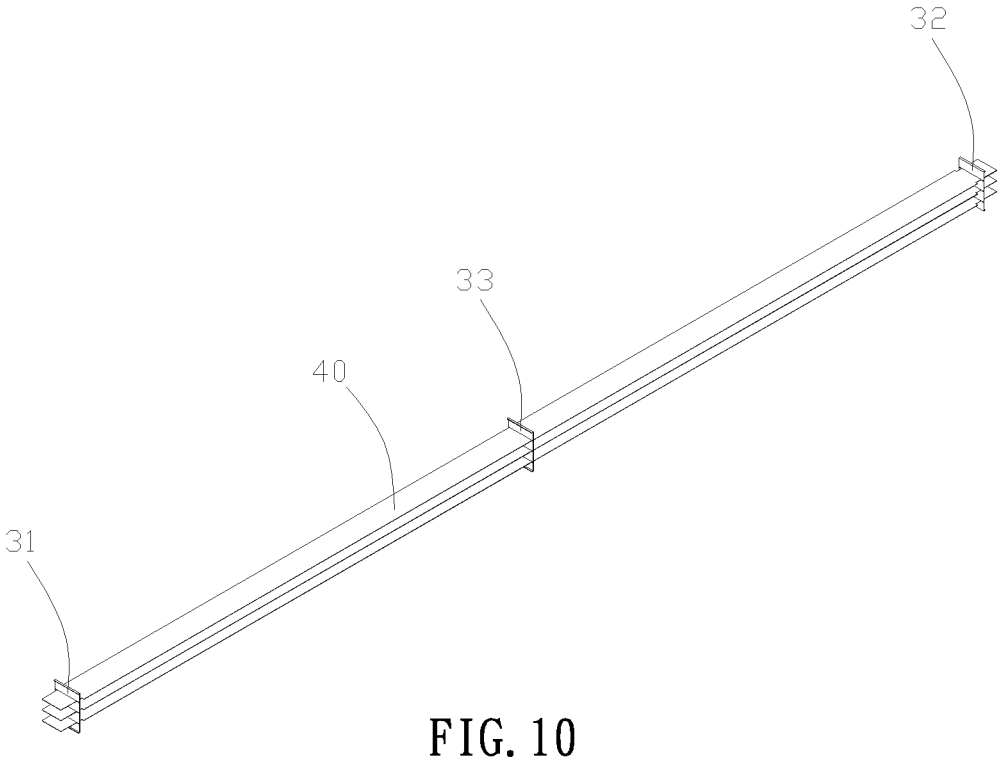
FIG. 10 is a partial perspective view of an inflatable cushion structure in accordance with a further preferred embodiment of the present invention.

Referring to FIG. 10, the connecting unit 30 further includes at least one third connecting member 33 mounted between the first connecting member 31 and the second connecting member 32. Thus, the separation plates 41 of the separating material unit 40 are supported exactly to keep the partition layers 231 in each of the air passages 23.

Figure 11:
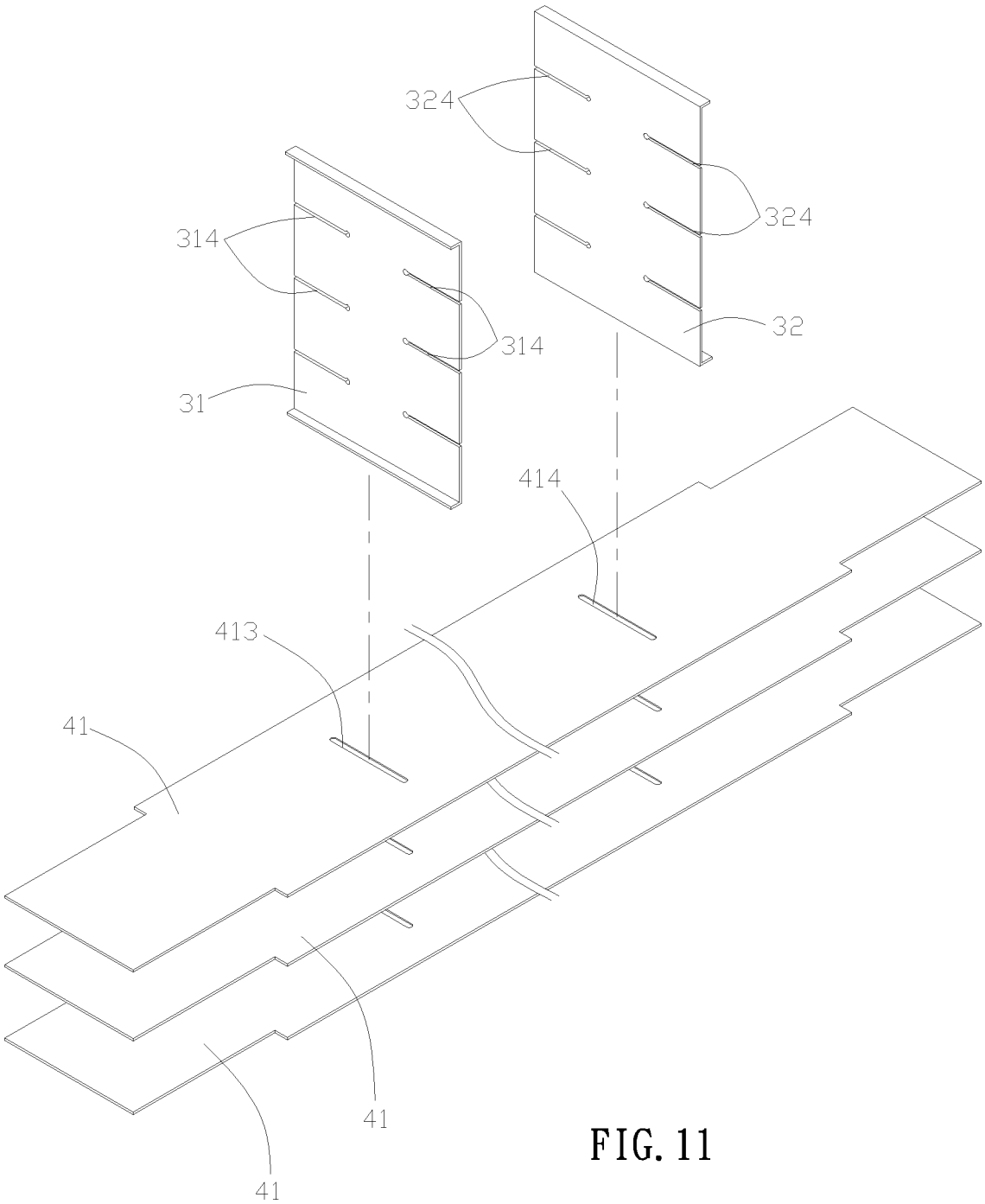
FIG. 11 is a partial exploded perspective view of an inflatable cushion structure in accordance with a further preferred embodiment of the present invention.
Figure 12:
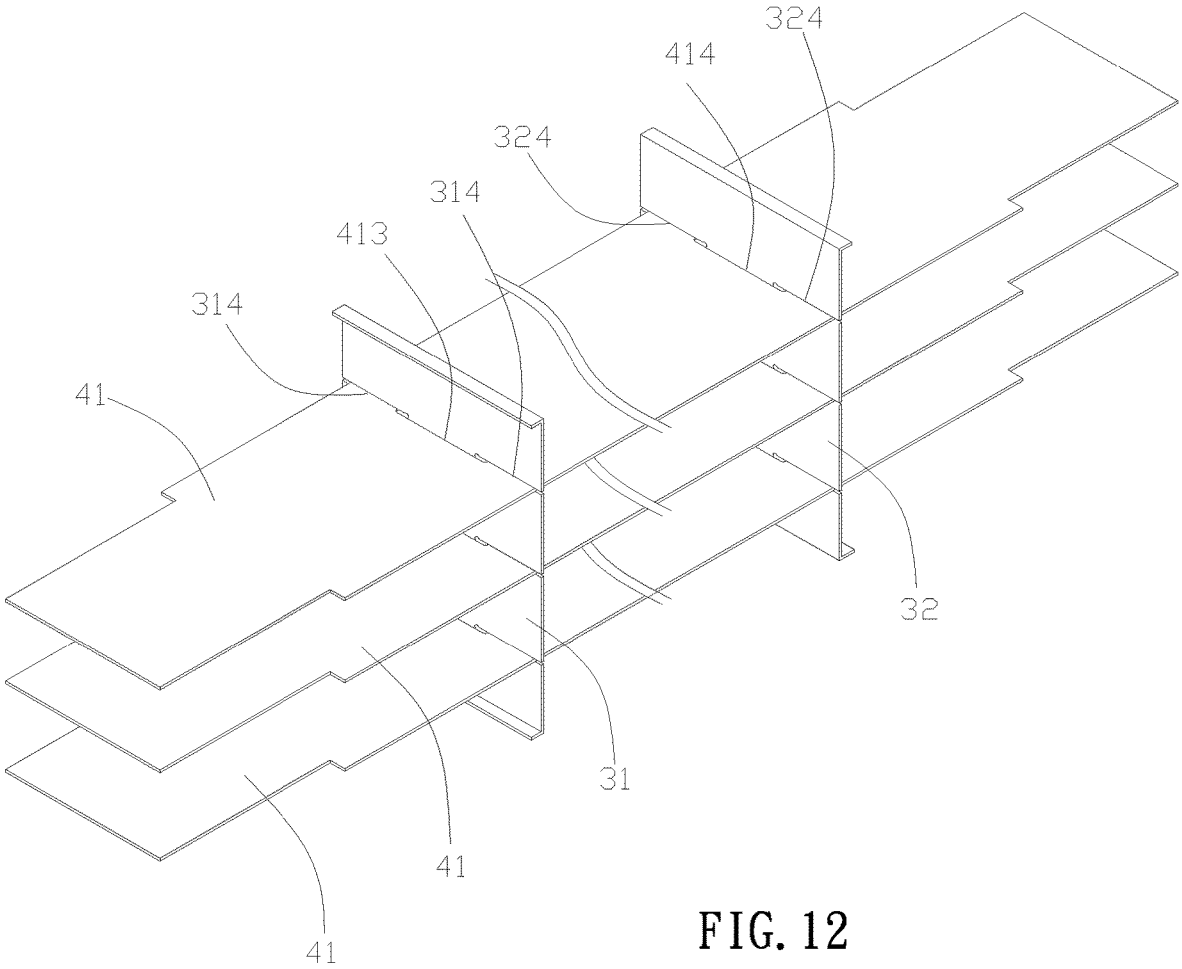
FIG. 12 is a perspective assembly view of the inflatable cushion structure as shown in FIG. 11.

Referring to FIGS. 11 and 12, the first connecting member 31 is provided with multiple third transverse slits 314 equally spaced from each other from top to bottom. The second connecting member 32 is provided with multiple fourth transverse slits 324 equally spaced from each other from top to bottom. Each of the separation plates 41 of the separating material unit 40 is provided with a left slot 413 aligning with the third transverse slits 314 and a right slot 414 aligning with the fourth transverse slits 324. In such a manner, the connecting unit 30 is made of TPU or soft plastic material, so that the connecting unit 30 is flexible and bendable. Thus, the left slot 413 and the right slot 414 of each of the separation plates 41 are allowed to pass through the third transverse slits 314 of the first connecting member 31 and the fourth transverse slits 324 of the second connecting member 32 so that the connecting unit 30 and the separating material unit 40 are combined and limited exactly.

Accordingly, the inflatable cushion structure of the present invention has the following advantages.

1. The separating material unit 40 is mounted in each of the air passages 23 of the inflatable cushion 20. The separating material unit 40 includes multiple separation plates 41 which divide each of the air passages 23 of the inflatable cushion 20 into multiple partition layers 231, so that the partition layers 231 form a spacing (or gap or interval) between the upper surface layer 21 and the lower surface layer 22 of the inflatable cushion 20 to slow down the air flow in each of the air passages 23, thereby achieving a warming effect efficiently.

2. Each of the separation plates 41 is made of soft material including an aluminum film or a polyester film so that the separating material unit 40 is bendable, has a high reflectivity and low absorption rate, to reduce the temperature radiation efficiently, thereby achieving a warming effect.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. An inflatable cushion structure comprising:

an inflatable cushion, a connecting unit, and a separating material unit;

wherein:

the inflatable cushion includes an upper surface layer, a lower surface layer, multiple air passages, and an air valve;

the upper surface layer has an interior coated with a TPU (thermoplastic polyurethane) layer;

the lower surface layer has an interior coated with a TPU layer;

the TPU layers of the upper surface layer and the lower surface layer are air impermeable and are adhered mutually;

a periphery of the upper surface layer and the lower surface layer is sealed and fused;

the upper surface layer and the lower surface layer are stuck by a melting machine to form the air passages;

the air passages are parallel and connected to each other;

the air valve is provided on a side of the inflatable cushion;

the connecting unit is mounted in each of the air passages of the inflatable cushion;

the connecting unit includes a first connecting member and a second connecting member;

the first connecting member and the second connecting member are made of TPU or soft plastic material;

the first connecting member is located at a left side of each of the air passages;

the first connecting member is provided with multiple first transverse slits;

the second connecting member is located at a right side of each of the air passages;

the second connecting member is provided with multiple second transverse slits;

the separating material unit includes multiple separation plates;

each of the separation plates has a left end passing through one of the first transverse slits of the first connecting member; and each of the separation plates has a right end passing through one of the second transverse slits of the second connecting member.

2. The inflatable cushion structure as claimed in claim 1, wherein:

the first connecting member has an upper part provided with a first upper adhesive portion secured to the upper surface layer of the inflatable cushion;

the first upper adhesive portion is fused and positioned with the TPU layer in the upper surface layer;

the first connecting member has a lower part provided with a first lower adhesive portion secured to the lower surface layer of the inflatable cushion;

the first lower adhesive portion is fused and positioned with the TPU layer in the lower surface layer;

the second connecting member has an upper part provided with a second upper adhesive portion secured to the upper surface layer of the inflatable cushion;

the second upper adhesive portion is fused and positioned with the TPU layer in the upper surface layer;

the second connecting member has a lower part provided with a second lower adhesive portion secured to the lower surface layer of the inflatable cushion; and the second lower adhesive portion is fused and positioned with the TPU layer in the lower surface layer.

3. The inflatable cushion structure as claimed in claim 1, wherein the first transverse slits of the first connecting member are equally spaced from each other from top to bottom.

4. The inflatable cushion structure as claimed in claim 1, wherein the second transverse slits of the second connecting member are equally spaced from each other from top to bottom.

5. The inflatable cushion structure as claimed in claim 1, wherein the separation plates have a number equal to that of the first transverse slits and that of the second transverse slits.

6. The inflatable cushion structure as claimed in claim 1, wherein each of the separation plates is made of soft material including an aluminum film or a polyester film.

7. The inflatable cushion structure as claimed in claim 1, wherein the connecting unit further includes at least one third connecting member mounted between the first connecting member and the second connecting member.

8. The inflatable cushion structure as claimed in claim 1, wherein:

the first connecting member is provided with multiple third transverse slits equally spaced from each other from top to bottom;

the second connecting member is provided with multiple fourth transverse slits equally spaced from each other from top to bottom; and each of the separation plates of the separating material unit is provided with a left slot aligning with the third transverse slits and a right slot aligning with the fourth transverse slits.

* * * * *